US006145798A

United States Patent [19]

Janisse et al.

[11] Patent Number: 6,145,798

[45] Date of Patent: Nov. 14, 2000

[54] QUICK RELEASE FAN MOUNT

[75] Inventors: Mark T. Janisse, Tecumseh, Canada; Kevin Kayne, Armada; Jeffrey Kayne, Macomb, both of Mich.

[73] Assignee: Markrep Associates, Inc., Madison Heights, Mich.

[21] Appl. No.: 09/268,493

[22] Filed: Mar. 11, 1999

Related U.S. Application Data

[60] Provisional application No. 60/110,426, Dec. 1, 1998.

[51] Int. Cl.[7] ..... A47H 1/10

[52] U.S. Cl. ..... 248/324; 248/317; 248/343; 248/327; 248/323; 248/229.24; 248/229.1; 248/229.14; 248/229.11; 417/423.15

[58] Field of Search ..... 248/317, 343, 248/229.1, 229.14, 229.24, 226.11, 323, 327, 324; 417/360, 423.15

[56] References Cited

U.S. PATENT DOCUMENTS

| | | | |
|---|---|---|---|
| 2,000,386 | 5/1935 | Haynes | 230/273 |
| 2,022,028 | 11/1935 | Cornell, Jr. | 230/275 |
| 3,433,444 | 3/1969 | Smith | 248/279 |
| 4,373,696 | 2/1983 | Dochterman | 284/604 |
| 5,018,951 | 5/1991 | Wang | 417/423.15 X |
| 5,934,349 | 8/1999 | Faller | 248/343 X |
| 6,015,262 | 1/2000 | Huang | 417/360 X |

*Primary Examiner*—Ramon O. Ramirez
*Assistant Examiner*—A. Joseph Wujciak
*Attorney, Agent, or Firm*—Carlson, Gaskey & Olds

[57] ABSTRACT

A quick release mount for mounting a fan to a static structure includes a handle for moving a movable member between a locking position and a non-locking position. The handle being operable to move the moving member into and out of an opening in the fan such that the fan can be removed from the quick release mount by moving the handle and moving member to the non-locking position. Some embodiments do not require any tools for removal of the fan and allows the mount to be locked at a predetermined angle relative to the static structure. The other embodiment only requires simple tools. Thus, once the fan is reattached, it need not be readjusted to return to its desired angled position.

22 Claims, 4 Drawing Sheets

QUICK RELEASE FAN MOUNT

The present application claims priority to the U.S. provisional application filed Dec. 1, 1998, and assigned the U.S. Ser. No. 06/110,426.

BACKGROUND OF THE INVENTION

The present invention relates to a mount for a fan, and more particularly to a pivoting and locking mount structure to mount a fan in overhead locations such that the fan can be mounted at any one of several selectable angles and can be easily released for cleaning and repair.

In the prior art, fans are often mounted adjacent to the ceiling of the factory environment, and are difficult to reach. From time to time the fan must be removed for cleaning and repairs. In the prior art, the fans have been bolted to a pivoting lock structure, and have thus been removable by unbolting the bolts and nuts and then removing the assembled fan head and its associated motor.

This presents problems in two respects. First, the requirement of tools, etc., for removing the bolts and nuts was difficult, and time consuming and resulted in many loose parts. Remember, this work might occur high in the air. In a factory there may be thousands of fans, and the overall time required to remove the many fans was very time consuming. Further, reattaching the fans is particularly time consuming. The fans are mounted on a pivoting structure and adjustable to various angles. When reattaching the fan, the readjustment needed to occur over again.

SUMMARY OF THE INVENTION

The present invention overcomes the problems encountered with conventional fan mounts by utilizing a quick release connection between the fan motor and a pivoting mount structure. This quick release structure does not require any tools for removal of the fan. Instead, the quick release structure allows quick removal of the assembled fan head. At the same time, the quick release structure is locked at the predetermined angle relative to the mount structure. Thus, once the fan is reattached, it need not be readjusted to return to its desired angled position. Instead, the quick release structure is still at the proper angular position.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
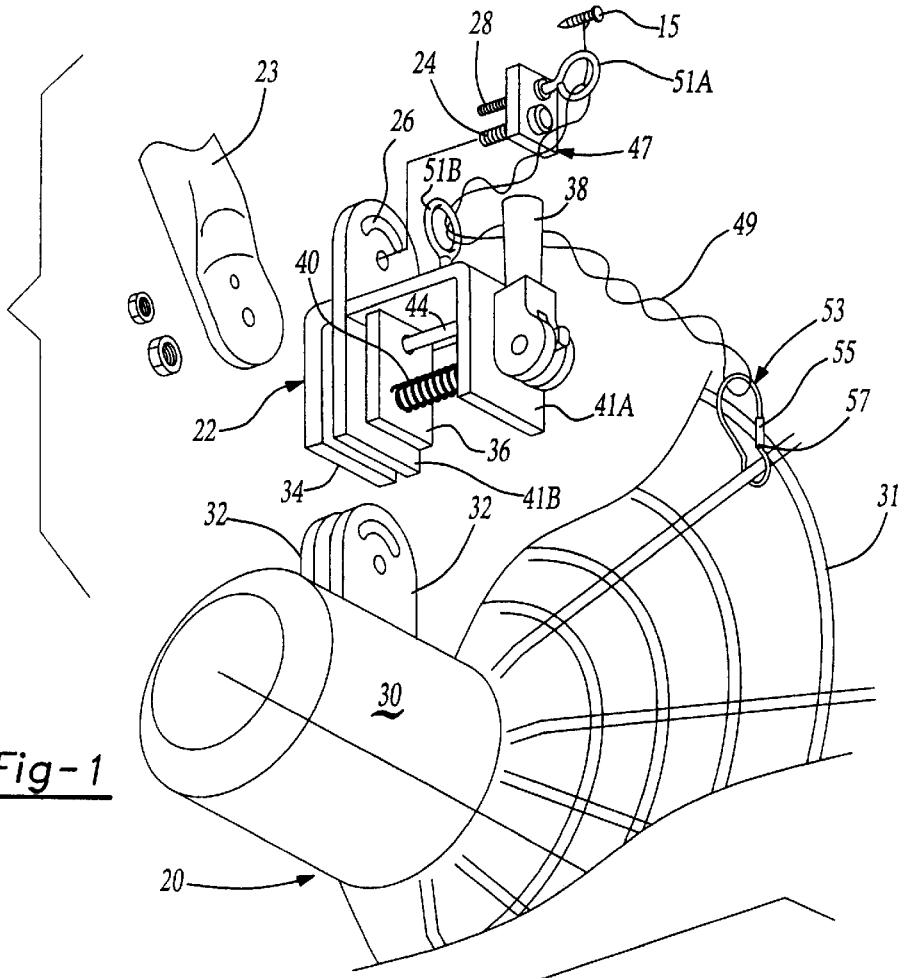
FIG. 1 is a detailed perspective view of a fan mounted to a quick release mount of the present invention.

FIG. 1 provides a detailed perspective view of a fan 20 and a quick release mount 22 of the present invention. As illustrated, a bolt 24 preferably locks the quick release mount 22 to a static structure 23. Static structure 23 may be associated with a ceiling of a factory, or other mount location. Although a fan is shown and described, one will realize that other devices can be similarly mounted to the static structures typically available in a factory, warehouse or manufacturing setting.

A slot 26 formed in the quick release mount 22 receives a locking bolt 28. The quick release mount 22 is adjusted to a desired angular by adjusting the position of the locking bolt 28 within slot 26 relative to the static structure 23. Upon obtaining the desired fan 20 position the bolts 24 and 28 are tightened.

The fan 20 typically includes a motor 30 having a pair of motor mount brackets 32. Other fan types employ a single bracket, and this invention extends to a fan of this type. The motor mount brackets 32 have a slot similar to slot 26, and had, in the prior art, been mounted directly to the static structure 23 to position the fan 20. In the prior art, the bolts 24 and 28 needed to be removed for the fan to be removed, such as for cleaning or repair. In the present invention the fan 20 is mounted directly to the quick release mount 22 such that the fan 20 is returned to an originally set position.

To fix the fan 20 to the quick release mount 22, a lock handle 38 moves a pin 40 to rotate. Pin 40 also allows a spring 42 to be overcome and move the pin 40 away from a locking position. A first fixed wall 41*a* is preferably fixed in relation to a second fixed wall 41*b*. A movable wall 36 and the second fixed wall 41*b* sandwich a bracket 32 of the fan 20 while a movable third wall 34 and the opposite face of the second fixed wall 41*b* abuts a second fan mount bracket 32.

As will be further explained below, the pin 40 passes through an opening 58 in the second fixed wall 41*b* and is threadably received in the third wall 34, but may be easily removed by turning the handle 38. Once the threads have been removed, the pin 40 may be withdrawn by pulling on the handle 38. This allows a quick release disconnection without the necessity of any tools. A second pin 44 extends through the fan mount brackets 32 to further support the fan 20 within the quick connect mount 22.

As also shown, a mounting plate 47 retains the locking bolts 24,28 to provide an integral safety attachment. The device can thus be supported by a safety cable 49 which can extend through a first eyelet 51 a which is part of bolt 28 attached to the mounting plate 47, and a second eyelet 51*b* attached directly to the quick connect mount 22. Cable 49 is securely connected to a ceiling structure 15, passes through the first and second eyelets 51*a*, 51*b* and preferably, ends in a snap clasp 53. The snap clasp 53 can then be connected onto an available portion of the fan guard 31. The snap clasp 53 preferably includes a threaded latch 55 and a locking sleeve 57. The clasp 53 can be attached onto a portion of the fan guard and the locking sleeve 57 positioned so that the latch 55 can not become disengaged. If the quick release connection fails, or the brackets attached to the motor tear off, the cable 49 will still hold the fan 20 preventing it from falling. Additionally, by incorporating the bolts 24,28 to the mounting plate 47, the quick release mount 22 reinforces the static structure 23.

Figure 2:
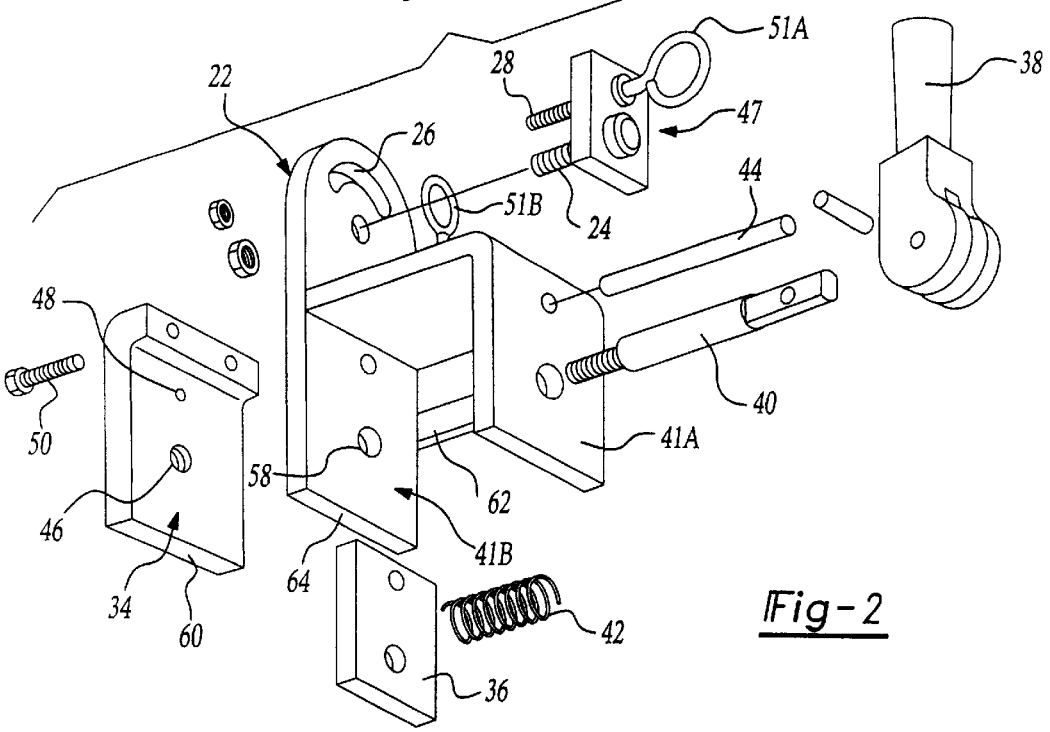
FIG. 2 is an exploded view of the quick release mount of the present invention.

Further details of the quick release mount 22 can be understood from FIG. 2. An opening 48 in an outer end of the third wall 34 receives the pin 44. Similarly, a threaded opening 46 receives the pin 40. The pin 40 and pin 44 are attached to, and movable along with, the movable wall 36. The pin 40 is biased to a locked position by a spring 42 which is contained between the movable wall 36 and the first fixed wall 41*a*. As shown, the third wall 34 is loosely held adjacent the second fixed wall 41*b* by bolts 50 or the like. As the bolts 50 only loosely hold the third wall 34, an outer end 60 of the third wall 34 floats relative to the second fixed wall 41*b* until the pin 40 is tightened. This allows the quick release mount 22 to accept bent fan brackets 32 (FIG. 1) and yet provide firm retention once the the pin 40 is tightened.

The first fixed wall 41*a* is preferably fixed substantially parallel to a second fixed wall 41*b*. Further, a wall 62 is positioned behind the mount to provide a stop. Similarly, the end 64 of the second fixed wall 41*b* extends between the mount brackets 32 to a position close to the fan motor 30, to provide a stop surface. The stop surfaces prevent the fan 20 from rotating should it start to slip on the mount.

Figure 3A:
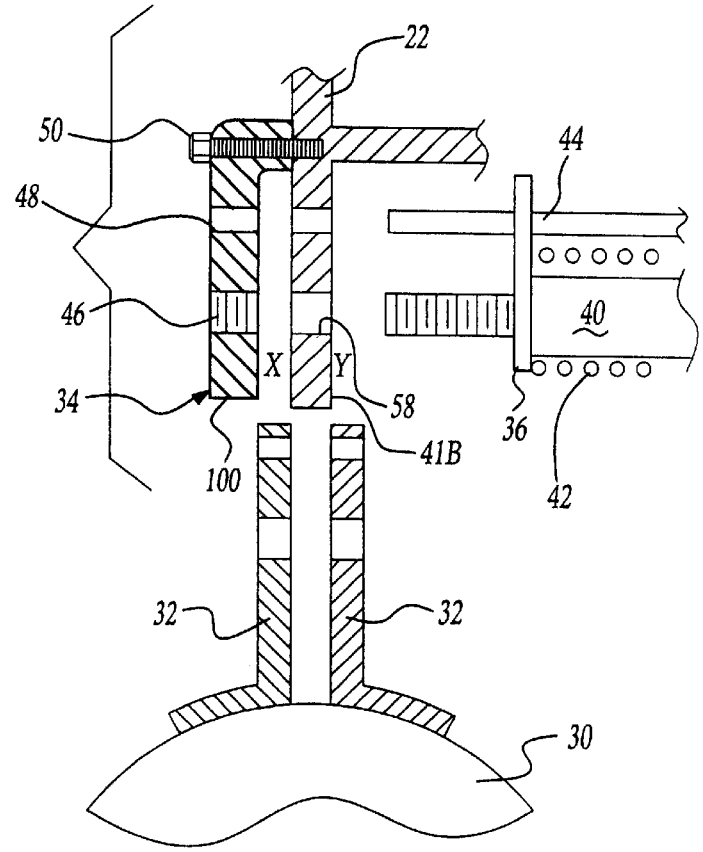
FIG. 3A is a partial cross sectional view of the quick release mount in a position receptive to the installation of a fan.

FIG. 3A further shows the structure of the quick release mount 22 in a position to receive the fan 20. The handle 38 is turned to unthread the pin 40 from the threaded opening 46 in the third wall 34*b*. At that time, the pin 40 can be pulled outwardly or to the right as shown in FIG. 3A. At that time, the movable wall 36 and pin 44 will move with the pin 40. As shown, as the handle 38 is pulled the movable wall 36 is retracted against spring 42. The pin 40 will eventually move to create the spaces X and Y. At the same time, the pin 44 will be moving through the openings 48, and 54, and will also move out of the spaces X and Y. The spaces X and Y can then receive the brackets 32 from the motor of the fan. Thus, to release the fan 20, the operator may simply turn the handle 38, and then pull the pin 40 to the right as shown in FIG. 3A such that the pins 40 and 44 are moved outwardly of the openings in the bracket walls 32 of fan 20 (FIG. 1). At that time, the fan 20 can be placed within, or removed from the quick release mount 22.

Figure 3B:
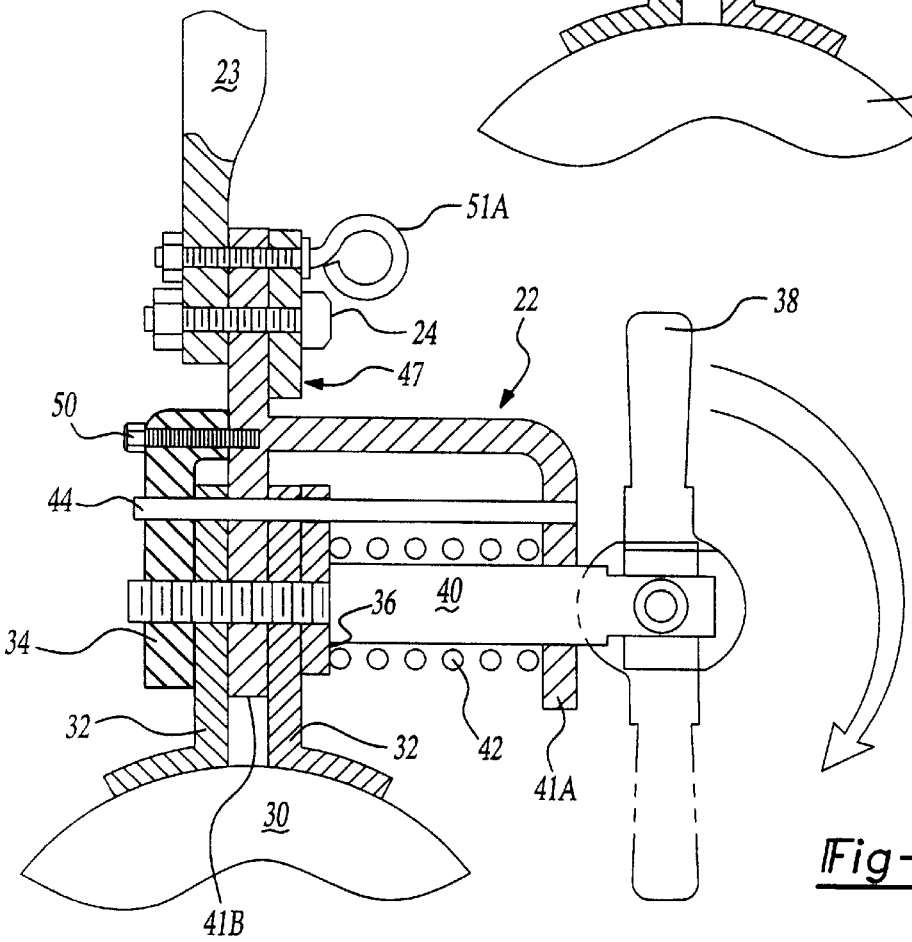
FIG. 3B is a partial cross sectional view of the quick release mount of the present invention attached to a fan.

As shown in FIG. 3B, to reattach the system, the fan brackets 32 are placed within the spaces X and Y. The handle 38 is released and the spring 42 moves the pin 40, pin 44 and the movable wall 36 to the left. The handle 38 is then turned such that the pin 40 is again threadably engaged in the threaded opening 46 of the third wall 34. Additionally, the handle 38 can then be toggled in relation to the pin 40 such that the toggled handle 38 further maintains the pin 40 in the locked position. The quick release mount 22 is then securely made to hold the fan 20 to the static structure 23. Thus, during the entire removal and replacement of the fan 20, the quick release mount 22 remains attached to the static structure 23 such that readjustment of the desired fan angle is not necessary.

Figure 4:
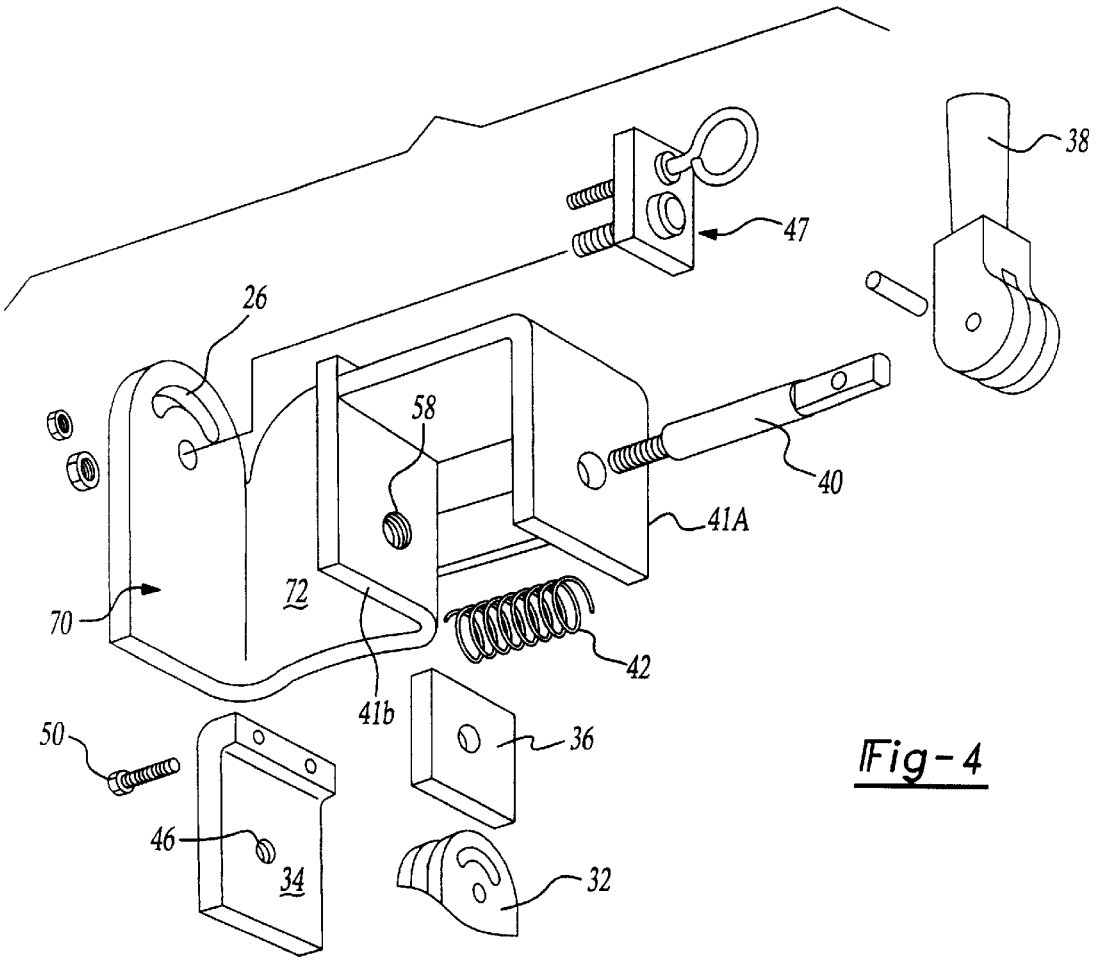
FIG. 4 is an exploded view of an alternate embodiment of the quick release mount of the present invention.
Figure 5:
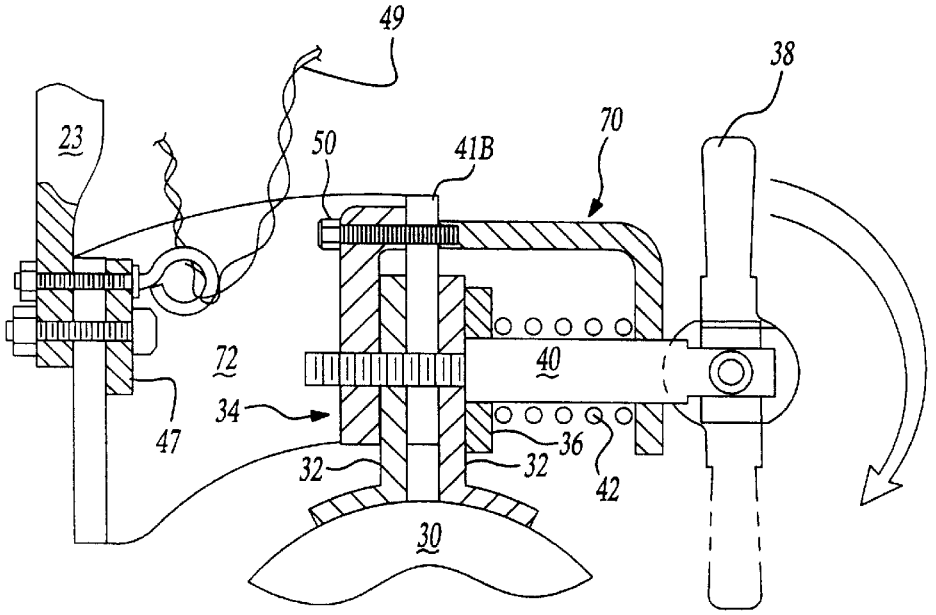
FIG. 5 is a partial cross sectional view of the quick release mount of FIG. 4.

FIG. 4 shows an exploded view of an alternate embodiment of the present invention which although operating in a similar manner as described above, provides an alternate configuration. The quick release mount 70 of FIG. 4 similarly locks a fan bracket 32 to a static structure 23 (FIG. 5) associated with a ceiling of a factory, or other mount location. However, the quick release mount 70 of FIG. 4 eliminates the pin 44 (FIG. 3) such that the quick release mount 70 is further simplified as all adjustments are made between the quick release mount 70 and the static structure 23. Further, the quick release mount 70 includes a laterally offset extension 72 from the walls 41*a*,41*b*, 34 and 36, such that other alternate mounting arrangements for the fan 20 are made possible. The offset extension 72 preferably laterally positions the fan bracket 32 to a static structure 23 such that the fan is mounted at the same vertical distance from the ceiling of a factory, or other mount location. This allows the maintenance of any previous clearance restrictions below the mounted structure.

Figure 6:
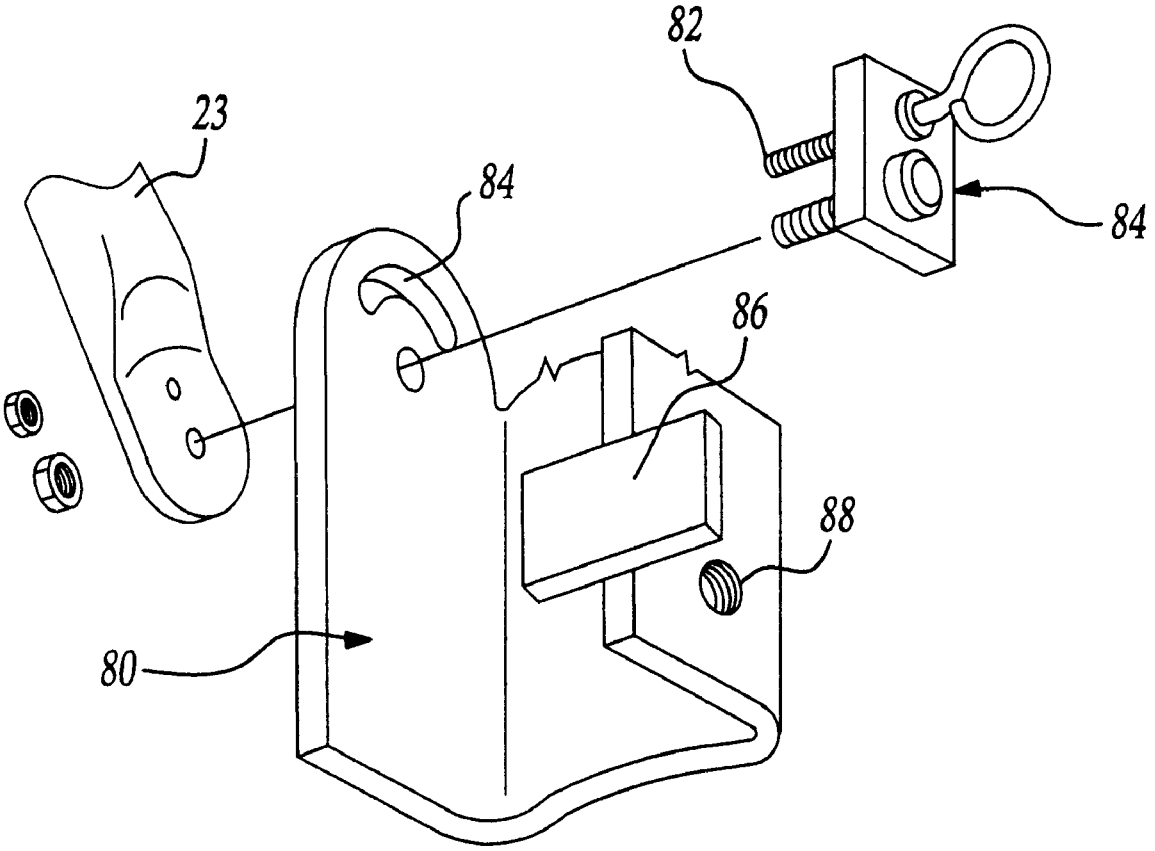
FIG. 6 is an exploded view of an alternate embodiment of the quick release mount of the present invention.

FIG. 6 shows an exploded view of an alternate embodiment of the present invention which although operating in a similar manner as described above, provides a simplified configuration. The quick release mount 80 of FIG. 6 is even further simplified such that all adjustments are made between the quick release mount 80 and the static structure 23. The quick release mount 80 is adjusted to a desired angle by adjusting the position of a bolt 82 integral to a locking plate 84 within slot 85 relative to the static structure 23. The fan or other structure can then be mounted as normal with a bolt or the like through bolt hole 88. Preferably, a wall 86 is attached to the mount to provide a stop surface for the fan mount brackets 32 (FIG. 1) to restrain the fan from rotating within the mount. Thus, during the entire removal and replacement of the fan, the quick release mount 80 remains attached to the static structure 23 such that readjustment of the desired fan angle is not necessary.

The present invention allows the quick and efficient mounting and removal of a device to a static structure. In a secondary benefit, this inventive mount will serve to straighten bent motor brackets as they are clamped between the mount walls.

The foregoing description is to be exemplary rather than defined by the limitations within. Obviously, many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the present invention may be practiced otherwise than as specifically described. For that reason the following claims should be studied to determine the true scope and content of this invention.

What is claimed is:

1. A quick release mount for mounting a device to a static structure comprising:

a handle for moving a movable member between a locking position and a non-locking position, said handle being operable to move said moving member into and out of an opening in a removable device such that the removable device can be removed from said quick release mount by moving said handle and said moving member to its non-locking position, said mount structure includes a slot to variably position said mount structure in relation to the static structure.

2. The quick release mount according to claim 1, wherein said handle is movable in relation to said moving member, said handle movable such that said moving member is retained in said locking position.

3. The quick release mount according to claim 1, wherein said moving member is threadably engagable with said quick release mount.

4. The quick release mount according to claim 1, wherein said moving member is spring biased to said locking position.

5. The quick release mount according to claim 1, wherein said moving member includes a wall portion sandwiching a device bracket between said wall portion and a wall of said quick release mount such that said device is immobilized therebetween.

6. The quick release mount according to claim 1, further comprising a stop surface such that the device is prevented from rotating.

7. A quick release mount for mounting a device to a static structure comprising:

a handle for moving a movable member between a locking position and a non-locking position, said handle being operable to move said moving member into and out of an opening in a removable device such that the removable device can be removed from said quick release mount by moving said handle and said moving member to its non-locking position; and a safety cable attachable to a portion of the removable device.

8. The quick release mount according to claim 7, wherein said mount structure includes a slot to variably position said mount structure in relation to the static structure.

9. A quick release mount and fan for mounting to a static structure comprising:

a fan;

a mount structure including a first and second wall, said mount structure attachable to the static structure;

a third wall attached to said mount structure;

a pin member having a locking position and a non-locking position, said pin member movable through an opening in said first and second wall to engage said third wall, said pin member movable into and out of an opening in said fan such that said fan can be inserted and removed from said quick release mount by moving said pin member to its non-locking position.

10. The quick release mount and fan according to claim 9, wherein said mount structure includes an arcuate slot to variably position said mount structure in relation to said static structure said mount structure offset from said static structure.

11. The quick release mount and fan according to claim 9, wherein said pin member includes a handle to move said pin member from said locking position to said non-locking position.

12. The quick release mount and fan according to claim 9, wherein said pin member is spring biased to said locking position.

13. The quick release mount and fan according to claim 9, wherein said pin member is threadably engagable with said third wall.

14. The quick release mount and fan according to claim 9, further comprising a clasp attachable to a portion of said fan.

15. A quick release mount fan and static structure comprising:

a static structure;

a fan;

a mount structure including a first and second substantially parallel wall, said mount structure attachable to said static structure;

a third wall attached to said mount structure;

a handle for moving a spring biased pin member between a locking position and a non-locking position, said pin member passable through an opening in said first and second wall to threadably engage said third wall, said pin member movable into and out of an opening in said fan such that said fan can be inserted and removed from said quick release mount by moving said pin member to its non-locking position.

16. The quick release mount according to claim 15, wherein said third wall is attached to said second wall, said second wall and said third wall sandwiching a fan bracket therebetween by moving said pin member to said locking position.

17. The quick release mount according to claim 15, wherein said pin member includes a forth wall, said forth wall and said second wall sandwiching a first fan bracket therebetween and said second wall and said third wall sandwiching a second fan bracket therebetween by moving said pin member to said locking position.

18. The quick release mount according to claim 15, wherein said handle can be toggled in relation to said pin member to retain said pin member in locking position.

19. A quick release mount for mounting a device to a static structure comprising:

a mount structure including a first and second substantially parallel wall, said first wall including an arcuate slot to variably position said mount structure in relation to said static structure, said device attachable to said second wall.

20. The quick release mount according to claim 19, wherein said device is attachable to said second wall with a bolt threadably engagable with said second wall.

21. The quick release mount according to claim 19, further comprising a stop surface such that said device is immobilized.

22. The quick release mount according to claim 19, wherein said device is offset from said static structure.

* * * * *